United States Patent [19]

Roberts

[11] 4,074,429

[45] Feb. 21, 1978

[54] NOVEL LATHERING DEVICE AND RAZOR ASSEMBLY

[76] Inventor: Thomas G. Roberts, Box 223, R.D. No. 3, Stroudsburg, Pa. 18360

[21] Appl. No.: 716,547

[22] Filed: Aug. 23, 1976

[51] Int. Cl.[2] ..... B26B 21/44
[52] U.S. Cl. ..... 30/41
[58] Field of Search ..... 30/41, 90, 86,

[56] References Cited

U.S. PATENT DOCUMENTS

| | | | |
|---|---|---|---|
| 1,899,841 | 2/1933 | Acken | 30/41 |
| 2,839,224 | 6/1958 | Lipka | 30/41 X |
| 3,045,343 | 7/1962 | Shalev | 30/41 |
| 3,895,437 | 7/1975 | DiBuono | 30/90 |

FOREIGN PATENT DOCUMENTS

| | | | |
|---|---|---|---|
| 1,177,096 | 12/1958 | France | 30/41 |

*Primary Examiner*—Jimmy C. Peters
*Attorney, Agent, or Firm*—Joseph W. Molasky

[57] ABSTRACT

A means and apparatus for applying lather and moisture to a shaving surface in advance of the razor blade so that the shaving operation can be conducted in a single stroke.

In one embodiment the lather is provided by a device which attaches to the handle of a conventional safety razor. This device is wetted to impart a lathering composition.

In a second embodiment, the lathering device is integrally joined to a razor handle comprising a water reservoir so as to supply moisture to a confined soap cake and thereby provide lather to the shaving surface.

16 Claims, 22 Drawing Figures

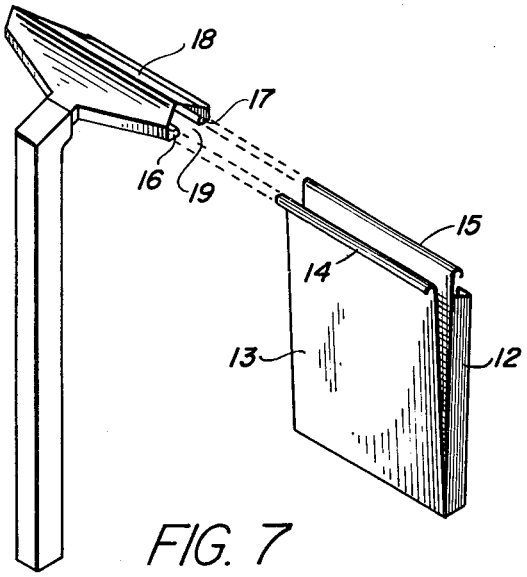
FIG. 7
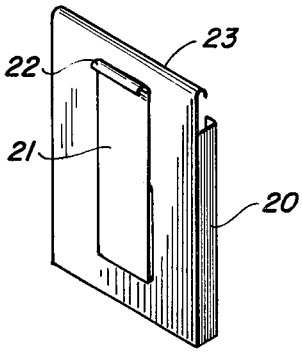
FIG. 8
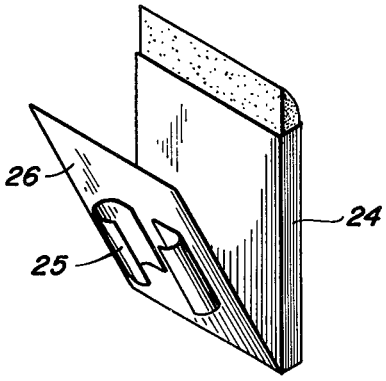
FIG. 9
FIG. 10
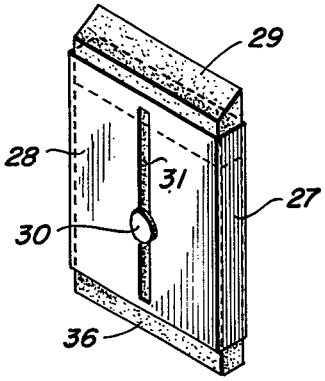
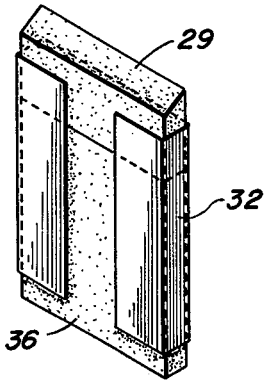
FIG. 11
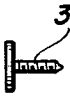
FIG. 10a
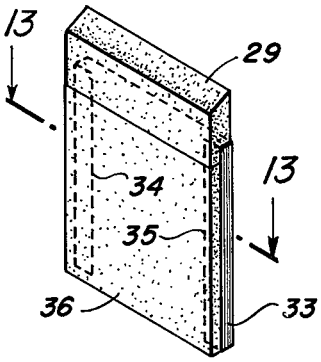
FIG. 12
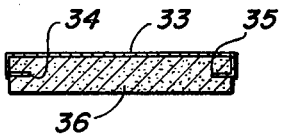
FIG. 13
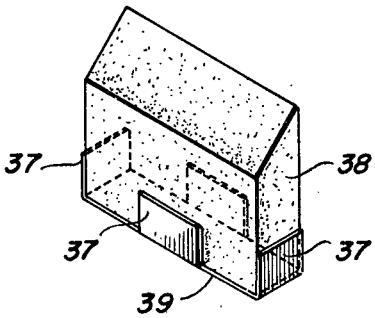
FIG. 14

NOVEL LATHERING DEVICE AND RAZOR ASSEMBLY

This invention relates to a means for wetting, lathering and shaving facial and other body hair in a single stroke.

More particularly, this invention relates to a lathering device which can be attached to a safety razor for the purpose of moisturizing and dispensing a lubricating lather in advance of the razor blade.

This operation is achieved by attaching to a conventional safety razor, a soap cake, a container for same and a means for securing said soap cake and container to the razor so as to maintain the combination in the desired position.

This invention also relates to a novel razor assembly in which the lathering device and shaving element are an integral unit.

BACKGROUND OF THE INVENTION

Lather dispensing razors are not uncommon in the art.

Indeed, one of the most common varieties is the hollow-handle razor covered by U.S. Pat. No. 1,867,980. According to that invention a supply of shaving cream is contained in the handle under pressure and it is automatically discharged therefrom through an aperture located opposite the razor's edge upon inserting a blade into the blade holder. Once the face has been lathered, the shaving element is turned around to the blade-side and the shaving step is commenced.

The disadvantage to a lather-dispensing razor of this type lies in the fact that it is relatively expensive. Furthermore, the razor handle must be uncommonly large so as to provide sufficient space for the lathering material and this only serves to render the razor more difficult to manipulate. But most importantly, such a device does not achieve the shaving operation in a single stroke because it required a separate wetting step prior to the shaving operation.

An alternative means is illustrated by U.S. Pat. No. 2,789,346. That invention relates to a disposable safety razor in combination with a soap-impregnated wad or lathering cream confined within an attached envelope. To utilize that device the soap-impregnated wad is moistened to create a lather and said lather is then applied to the user's face prior to the shaving operation. Alternatively, the lathering cream is employed by puncturing the envelope and compressing it to force the cream therefrom; whereafter, the said cream is applied to the face in a whisker-lathering manner.

The disadvantage to that device lies in the fact that once the soap-impregnated wad or lathering cream is expended it cannot be regenerated and the entire razor must be disposed of.

An improvement on the foregoing device is illustrated by U.S. Pat. No. 3,895,437. In that invention a spongeous element is secured to the razor in a position which immediately precedes the blade. The object is to maintain the spongeous element in a saturated condition so that upon contact with the lather on the user's face it moisturizes same by providing heat and lubrication immediately prior to the shaving step. Unfortunately, however, this device does not lather and moisturize simultaneously. In fact, the shaving operation actually requires four steps, namely, an initial wetting of the facial hairs, a separate lathering operation, the aforementioned moisturizing step and, the actual shaving operation.

In U.S. Pat. No. 2,743,732 there is described a means for lubricating and shaving in a single operation by automatically dispensing shaving cream from the handle portion of a razor. However, this device is a cumbersome affair and relatively expensive to maintain. Also, it contains material under pressure and thus constitutes something of a hazard. Furthermore, this device fails to provide moisture to the user's face and thus lacks one of the elements necessary for an effective and smooth shaving operation.

THE INVENTION

The present invention combines the moisturizing, lathering and shaving steps needed for an effective shave into a single function so that the entire procedure can be conducted in a single stroke. This operation is achieved by utilizing a device which can be attached to any one of a variety of commercially available safety razors.

In addition to its effectiveness, the present invention is also characterized by its ease of operation and economy. Unlike those devices which provide aerosol foams in the razor handle, the present device is not at all cumbersome or expensive to maintain. It need not be maintained under pressure and it requires only the utilization of a single soap cake to be put into operation.

Moreover, the device of this invention can be used with various types of safety razors. Thus, in addition to being usable with bonded razors of the single edge variety, the present device can also be attached to a double-edged safety razor and when one blade-edge is expended the device can be rotated on the razor handle so as to position it on the other, unused, razor blade side.

It is, therefore, an object of this invention to provide a lathering device which combines the simultaneous application of moisture and lather with the shaving step per se so as to facilitate the usual shaving operation.

More specifically, this invention relates to a lathering device which maintains a soap cake in a position immediately in advance of a razor blade so that a lathering composition can be applied to a shaving surface for the purpose of conducting a shaving operation in a single stroke.

This invention is economical to practice because the present device can be constructed from any natural or synthetic material such as metal, wood, plastic and the like, and it can be so designed as to appeal to the aesthetic sense of the user.

Economies are also achieved by utilizing a soap cake as the lathering substance. In practice, ordinary soap, combined with water, will provide an adequate lathering composition for use with the shaving implement.

Also, if desired, a spongeous moisturizing element can be adfixed to the lathering device so as to provide a constant supply of water to the soap cake. The moisturizing element can be any commonly available absorbent material such as a sponge of the natural or synthetic variety.

Conceptually, this invention consists of applying lather and moisture to the skin of the user immediately in advance of the blade so that the shaving operation is conducted in a single stroke.

According to one embodiment, this is achieved by attaching the lathering device of this invention to a conventional safety razor. This lathering device consists essentially of: (a) a soap cake, (b) a means for holding same, and (c) a means for securing the combination of soap cake and soap holder to the razor.

To practice this invention the combination of razor and lathering device is simply immersed in water or wetted by alternative means and the razor is drawn across the user's face in the ordinary manner. The positioning of the lathering device on the razor is such that upon stroking the beard the soap cake comes into intimate contact with the user's face and thus provides a lubricating composition immediately in advance of the razor blade.

The soap cake which is held by the lathering device of this invention has an essentially flat surface and is of such a dimension that its width is substantially the same as that of the razor blade.

This device is secured to the razor handle by any one of several means. According to one aspect of this invention the device is secured to the handle by a frictional clamp or by a spring clamp or, alternatively, by a pressure sensitive adhesive.

A second embodiment of this invention relates to a new razor assembly comprising a lathering device in combination with a shaving head. In this assembly the moisturizing liquid is maintained in the razor handle, and the said liquid is emitted through a port located between the razor's edge and the soap cake where it comes into immediate contact with the latter.

More specifically, this embodiment comprises:

a. an elongated chamber with continuous walls which, in addition to serving as a handle for the razor assembly, also serve as a water container with the rear wall thereof possessing an aperture through which water can be supplied to the container and which can be used for water discharge when the razor assembly is not in use.

b. a soap cake secured to the front side of the said chamber by a lathering container; and c. a razor head which is secured to the top of the said assembly. This razor head is equipped with a gate for securing the razor blade when the assembly is to be used, and, for its ejection when it is not in use.

In this assembly the water within the elongated chamber is emitted through a linear port located immediately beneath the leading edge of the razor blade head so that, in operation, the water passes directly over the surface of the soap cake in advance of the razor's cutting edge.

This invention will now be described by reference to the Drawings. However, it is to be understood that the Drawings are merely illustrative and are not intended to be limitative; therefore, any modification in design of the present device, which does not alter its purpose or basic function, is considered as being within the scope of this invention.

THE DRAWINGS

FIG. 7 is a perspective view of an alternative lathering device shown with an accommodating razor.

FIG. 8 is a perspective view of a lathering device with spring-clip means for attachment to the razor of FIG. 7.

FIG. 9 is a perspective side view of a lathering device with clamping means.

FIG. 10 is a perspective side view of a lathering device in combination with a button means for raising and lowering a soap cake.

FIG. 10A is a side view of the button means of FIG. 10.

FIG. 11 is a front view of a lathering device having a partially exposed soap face.

FIG. 12 is a perspective side view of an alternate lathering device having a totally exposed soap face.

FIG. 13 is a top view of the lathering device of FIG. 12.

FIG. 14 is a perspective view of still another lathering device illustrating lateral support means for a soap cake.

This invention has for its object the application of a minor amount of soap and moisture to the user's face immediately in advance of the razor's cutting edge. That object is achieved by either of two means.

Figure 1:
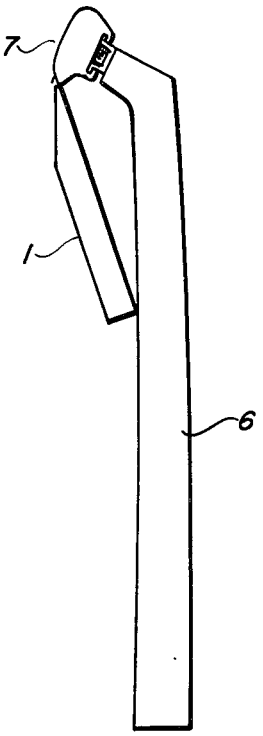
FIG. 1 is a conceptual view of this invention.

According to one embodiment of this invention the application of soap and moisture is accomplished by attaching to a safety razor one of the lathering devices of this invention. The conceptual aspects of this embodiment are illustrated by FIG. 1.

Figure 15:
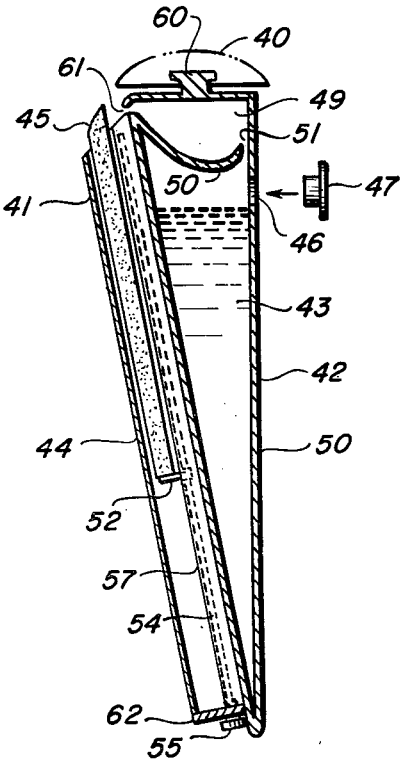
FIG. 15 is a side view of a razor assembly comprising a razor head, a lathering device and a moisturizing means.

The second embodiment of this invention relates to a new razor assembly which combines the elements of a safety razor with a novel means for applying a minor amount of soap and water to the user's face immediately prior to contact with the razor's cutting edge. This embodiment is illustrated by FIG. 15.

Hereinafter, the combination of soap and moisture will be referred to as a lathering composition and the device which provides the composition will be referred to as the lathering device.

This invention will now be described by reference to the individual Drawings.

FIG. 1 is an illustration of the conceptual means by which the lathering composition of this invention is usable with a safety razor. As illustrated, a soap cake is positioned on the handle of a conventional razor immediately in advance of the razor blade edge. Upon wetting the soap cake, a lathering composition is produced and this substance is applied to the user's face with each shaving stroke. The water, or moisture, which is needed to produce the lathering composition is provided by wetting the soap cake as, for example, by immersing it in water or by holding it under a faucet. However, in an optional embodiment of this invention, water can be provided by equipping the soap cake with a spongeous element saturated with water. The said element will maintain a reservior of water over a given period and thus provide the soap cake with sufficient moisture to produce a lathering composition.

This invention will now be described by reference to the various lathering devices which can be used for holding the soap cake to the razor blade handle of a conventional razor.

Figure 2:
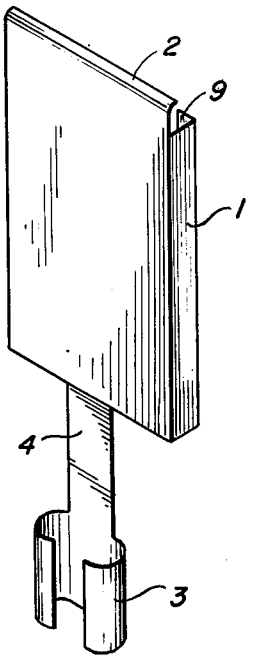
FIG. 2 is a perspective view of a lathering device of this invention.

FIG. 2 illustrates a lathering device for attachment to a safety razor. In this device the soap holder element 1 is fixedly secured to an extension member 4 equipped with means for securing said element to a razor handle.

Extending across the top of this soap holder element is a brace member 2 which, in combination with the razor, abuts the razor head 7 along its underside (FIG. 3) so as to maintain soap holder element 1 in an operable position. Adjacent to brace member 2 is soap holder opening 9. When soap cake is placed into the soap holder 1 its upper edge is positioned to extend slightly from the soap holder opening 9.

Figure 3:
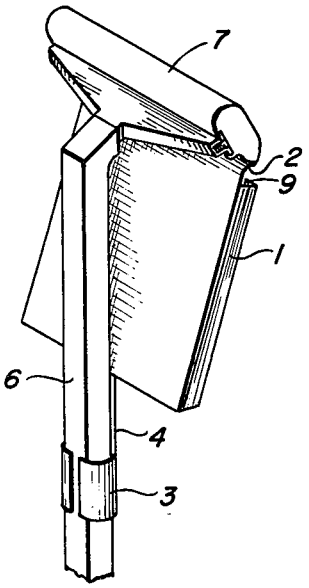
FIG. 3 is a perspective view of the lathering device of FIG. 2 shown assembled on a safety razor.

FIG. 3 shows the application of the lathering device of FIG. 2 to a conventional safety razor. The soap holder 1 is secured to handle 6 of the razor by securing the frictional clamp 3 to the razor handle and positioning the brace member 2 beneath and against the leading edge of the razor head 7.

Figure 4:
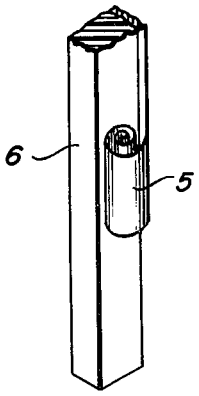
FIG. 4 is a sectional side view of an alternative means for securing the lathering device of FIG. 2 to a razor handle.

FIG. 4 illustrates an alternative means for securing the soap holder 1 to razor handle 6. According to this embodiment a spring clamp 5 is substituted for frictional clamp 3 of FIGS. 2 and 3 and the coiled arms thereof are tensionally secured to opposite sides of handle 6.

Figure 5:
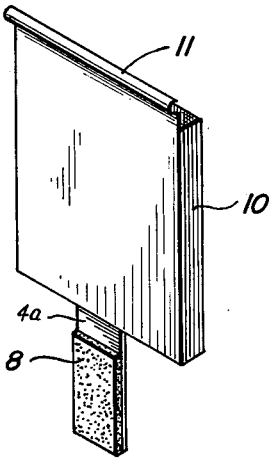
FIG. 5 is a perspective side view of a lathering device with adhesive means for securing same to a razor handle.
Figure 6:
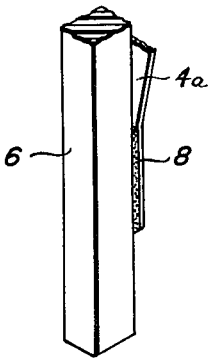
FIG. 6 is a sectional side view of the lathering device of FIG. 5 shown attached to the handle of a razor.

FIGS. 5 and 6 illustrate still another means for attaching the soap holder to the razor handle. According to this aspect of the invention a water-proof pressure sensitive adhesive 8, protected by a peel-off covering, is adfixed to extension member **4*a* of soap holder element 10**.

When the brace member 11 is properly positioned under the razor head, the soap holder 10 is secured to the razor handle 6 by removing the protective backing from the adhesive element 8 and securing it to the razor blade handle 6 by the application of pressure (FIG. 6).

In FIGS. 2, 3 and 5 brace members 2 and 11 are depicted as integral parts of the soap holder element 1; however, it is to be understood that said brace members are simply optional and not strictly necessary to maintaining the soap holder elements 1 and 10 in an operable mode. Indeed, the said soap holder element can be maintained in the desired position by simply utilizing a sufficiently rigid extension member 4 or **4*a***, which can be set and maintained at the desired angle.

FIGS. 7 and 8 illustrate soap holders which utilize a tensional means for securing same to the razor assembly. In FIG. 7 the soap holder element 12 is constructed in such manner that the spring clip 13 and the back side of the soap holder element 12 form a tensional V. Along the upper leading edge of spring clip 13 and soap holder element 12 are curved brace members 14 and 15 which are constructed to fit the accommodating grooves 16 and 17 in razor head 18.

The soap holder element is mounted onto razor head 18 by compressing the V formed by spring clip 13 and soap holder 12 so that it fits the razor head opening 19. Thereupon, the brace members 14 and 15 are inserted into razor head opening 19 where the said brace members slidably engage the accommodating grooves 16 and 17. When the insertion is completed, the tensional force on spring clip 13 and holder element 12 is released so that the tensional V can expand and bring brace members 14 and 15 into an intimate and securing contact with grooves 16 and 17.

FIG. 8 illustrates an alternative soap holder element for use with the razor of FIG. 7. In this embodiment a curved clip 21 is fixedly secured to the back side of a soap holder element 20. To engage this device with razor head 18 the clip 21 is compressed slightly in the direction of the soap holder element 20 so that the brace members 22 and 23 can fit the razor head opening 19 (FIG. 8). Once fitted into said opening, the compression on clip 21 is released so as to bring brace members 22 and 23 into engagement with the accommodating grooves 16 and 17.

FIG. 9 illustrates a combination of a clip and clamping means for securing a soap holder element 24 to a razor handle. In this embodiment a frictional clamp 25 is secured to a clip 26 which is integrally formed with soap holding element 24. The said clip is sufficiently rigid so as to be placed in any desired position or angle. Thus, upon securing clamp 25 to a razor handle any adjustment in the angle of soap holding element 24 can be made by simply expanding or compressing the tensional V formed by clip 26 and element 24.

The soap cake which is securely held by soap holder elements 1, 10, 12, 20 and 24 can be raised or lowered or otherwise positioned therein by adjusting same with one's fingers. Alternatively, the face of the container element may contain an opening to permit the entry of a device which can be inserted into the soap cake as a raising and lowering means. FIGS. 10–14 illustrate there various means.

In FIG. 10 the soap holder element 27 possesses a vertical aperture 31 in its front face 28. The soap cake 29 is raised, lowered and otherwise positioned therein by the insertion of a button 30 (FIG 10A) which passes through aperture 31 and into the soap cake 29. Thus secured, the said button can be used to raise or lower the soap cake within holder element 27 by simply moving it up or down within said aperture.

Although button 30 is shown only in combination with one soap holder element, namely, element 27 of FIG. 10, nevertheless, it is to be understood that this button means can also be utilized with the soap holder elements depicted in FIGS. 2, 5 and 7–11.

It should also be noted that the soap holding element of this invention can accommodate several soap cakes simultaneously. Thus, for example, in FIGS. 10, 11 and 12 the dotted lines indicate the point of division between an upper or first soap cake 29 and a lower or second soap cake 36. As the first soap cake 29 reaches its terminus a second soap cake 36 is inserted beneath it so as to provide the former with support and, also, to provide a new lathering component to take the place of the first soap cake once it is expended. When the soap cakes are wetted to provide a lather the first and second soap cakes eventually fuse together to form a single unitary cake.

FIG. 11 illustrates another means for raising and lowering the soap cake in the soap holding element 32. In this element the face of the soap holder has a portion of its cover removed so that the soap cake can be raised or lowered manually by bringing pressure to bear upon the soap surface. Alternatively, the soap can be raised or lowered by impressing into its exposed front surface the button of FIG. 10A and using this element as the means for positioning it within soap holding element 32.

FIGS. 12 and 13 illustrate a variation on the soap holder element of FIG. 11. In these Figures the width of holder element 33 is approximately one-half the thickness of soap cakes 29 and 36 and its vertical edges 34 and 35 are impressed into the soap cake sides to serve as a guide and holding means therefor and, also, as a track or guide for the raising or lowering of said soap cake. In this embodiment, the soap cakes 29 and 36 are raised or lowered by simply bringing pressure to bear upon the soap cake face.

FIG. 14 depicts still another soap holding element of this invention. In this element the support for soap cake 38 is provided by a base 39 and several vertical members 37. Since it is impractical to utilize more than one soap cake in this type of holder, the entire element is discarded once the soap has been expended or reduced to a unusable size.

FIGS. 15–21 cover a second embodiment of this invention. According to this embodiment the combination of moisturizing, lathering and shaving means are brought together into a single assembly. This assembly consists essentially of a razor blade head in combination with a soap cake holder and a water container which provides moisture to the soap cake and shaving surface. In addition to serving as a reservoir, the water container element also provides the user with a convenient means for holding and manipulating the shaving apparatus.

This assembly will now be described in greater detail by reference to FIGS. 15–21.

In FIG. 15 the assembly is depicted as a tapered apparatus 42 which serves as a container for the water 43. The said container is comprised of continuous wells which are essentially flat along its front and rear surfaces. The soap holder 41 is integrally joined to the front surface and is pitched at an angle of from about 5°–10° so that soap cake 45 will be disposed at a proper angle for contact with the shaving surface.

The rear wall of apparatus 42 is provided with an aperture 46 for the addition of water into the container handle and, also, for the emission of same when the apparatus is no longer in use. A stopper 47 is used to plug the aperture and prevent the accidental emission of water from the container handle.

Figure 16:
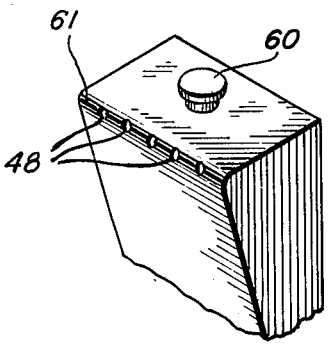
FIG. 16 is a fragmentary side view of the water outlet element in the assembly of FIG. 15.
Figure 18:
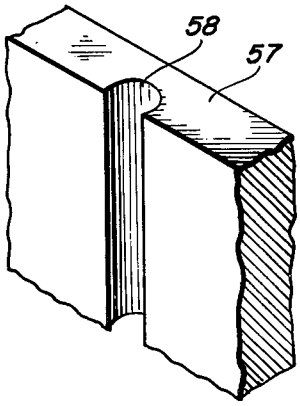
FIG. 18 is a blown-up sectional view of the rear wall in the soap cake holder depicted in FIG. 15.

At the top of apparatus 42, on the front side 44, and immediately beneath the razor head 40, is a water outlet element 61 containing several evenly spaced outlet ports 48 (FIGS. 15 and 16). Water entering chamber 49 is uniformly emitted through outlet element 61 and ports 48 for contact with soap cake 45 and the shaving surface. A deflector 50 defines a chamber 49 within the container handle and, in combination with rear wall 50, provides a passageway 51 for limiting the flow of water into said chamber.

In practice, the deflector 50 becomes operational only when the shaving apparatus 42 is in a position which is other than upright. When, for example, it is desired to place water in chamber 49 for emission through outlet ports 48 the apparatus 42 is tilted in the direction of its rear wall so that the water can flow through passageway 51 into chamber 49. Thereafter, upon tilting the razor toward front side wall 44 the water in chamber 49 is emitted through outlet ports 48 where it comes into contact with soap cake 45 and the shaving surface. FIG. 16 illustrates a front view of the water outlet element 61 with ports 48 for the uniform distribution of water from chamber 49.

Figure 19:
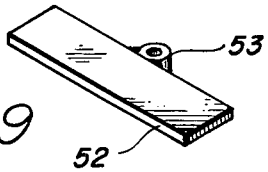
FIG. 19 is a perspective view of the soap platform and threaded boss depicted in FIG. 15.
Figure 20:
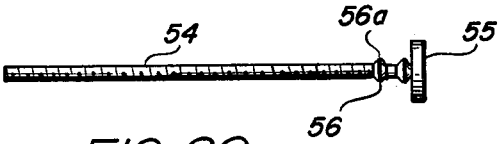
FIG. 20 is a side view of a threaded screw which is used in combination with the soap platform and threaded boss of FIG. 19.
Figure 21:
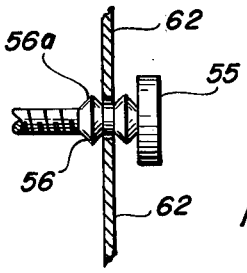
FIG. 21 is a blown-up sectional view of the head and flange portions of the threaded screw depicted in FIG. 20.

The apparatus 42 of FIG. 15 also provides a novel means for raising and lowering the soap cake 45 within the receptacle or soap cake holder 41. This is accomplished by resting the base of the soap cake 45 within holder 41 on a platform 52 which is provided with a threaded boss and an accommodating screw. By threading the screw through said boss the platform can be raised or lowered and thus achieve a corresponding raising or lowering effect of the soap cake. FIGS. 19 and 20 illustrate this platform and screw assembly.

Specifically, FIG. 19 illustrates the soap platform 52 with its threaded boss 53. The boss 53 accepts the accommodating screw 54 (FIG. 20) and, upon revolving the screw head 55, the combination of boss and screw serves to raise and lower platform 52 and the soap cake 45 which is placed thereon.

Figure 17:
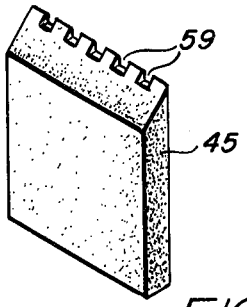
FIG. 17 is a partial perspective view of a soap cake which can be used in the razor assembly of FIG. 15.

In a preferred aspect of this invention the soap cake 45 is provided with serrations or channels 59 through which water can flow from chamber 49 over the soap cake to provide an even distribution of lather (FIG. 17).

To assure a snug fit for the soap cake in soap cake holder 41 it is desirable to avoid contact between the former and threaded screw 54. This is achieved by placing the threaded screw 54 into a cavity 58 which is located in the rear wall of said soap holder. In addition to accommodating screw 54 the cavity 58 also accepts threaded boss 53 and thus assures that the interior of the soap holder element is occupied only by the soap cake 45 and platform 52. As a result of this design, the soap cake 45 is securely confined within the soap holder element and this makes possible the proper positioning of the soap cake edge along ports 48 of water outlet element 61.

To utilize the apparatus of FIGS. 15–21, water is poured through aperture 46 of the shaving apparatus 42 and plug 47 is inserted into the said aperture so as to secure the water within the container handle.

A soap cake is placed on a platform 52 within the soap cake holder 41 and the threaded screw 54 is inserted through boss 53 and it is threaded therein until the upper leading edge of the soap cake is in registry with the water outlet element 61.

A razor head containing one or more shaving blade edges is inserted over the razor head holder 60 and it is locked in place (FIG. 15). Thereafter, the shaving operation is commenced by permitting the water 43 in the container handle to enter chamber 49 where it is emitted through exit ports 48 of the shaving apparatus (FIG. 16) for contact with soap cake 45 and the shaving surface.

It will be obvious to those skilled in the art that the present invention lends itself to modification in design and function; however, insofar as those modifications constitute only a change in the design of the present assembly and do not constitute a radical departure therefrom, such changes are implicitly included within the scope of this invention.

I claim:

1. A lathering device for attachment to a razor to provide a lathering composition in advance of the razor blade, which comprises:

a. a soap cake;

b. a container means for holding said soap cake; and c. a means for securing the combination of soap cake and container means to said razor.

2. The lathering device of claim 1 in which the soap cake is characterized by an essentially flat surface which lies on the same plane and immediately in advance of the razor's cutting edge.

3. The lathering device of claim 2 in which the flat surface of the soap cake and the razor's cutting edge are of about the same dimension.

4. The lathering device of claim 1 in which the container for the soap cake is secured to the razor by a clamping element which grips the razor handle.

5. The lathering device of claim 4 in which the container for the soap cake is attached to the clamping element by an extension member which joins the said container to the said clamping element.

6. The lathering device of claim 1 in which the container for holding the soap cake is attached to the razor head.

7. The lathering device of claim 1 in which the container for the soap cake is adfixed to the razor handle by a pressure sensitive tape.

8. The lathering device of claim 2 in which the container for the soap cake includes means for raising the soap within the container so as to bring the upper surface thereof adjacent to and immediately in advance of the razor's cutting edge.

9. The lathering device of claim 1 in which the soap cake holding means (b) possesses vertical edges which are impressed into the sides of said soap cake to serve as a guide for raising and lowering same.

10. The lathering device of claim 1 in which the container for the soap cake includes a moisturizing element mounted onto the container and adjacent to the upper surface of the soap cake.

11. The lathering device of claim 1 in which the surface of the soap cake contains ridges for channeling water over the face of the soap.

12. A lathering device according to claim 1 consisting of an assembly comprising:

a. an elongated chamber which serves as a holding means for said assembly and, also, as a water container with aperture means for pouring water into and out of said chamber;

b. a soap cake secured to one side of the elongated chamber; and c. a razor blade head which is secured to the top of the assembly, said head having a gate and blade ejection means;

said chamber having linear ports along one edge of the razor blade head for the purpose of uniformly distributing the flow of water onto the soap cake.

13. The assembly of claim 12 in which the soap cake is held by a receptacle equipped with a platform means for raising and lowering said soap cake.

14. The assembly of claim 13 in which the platform is raised and lowered by a threaded screw which passes through an accommodating boss integrally connected to said platform.

15. The assembly of claim 12 in which the elongated chamber serving as the water container, possesses a deflector for limiting the amount of water which passes through the linear ports.

16. A lathering device for attachment to a razor to provide a lathering composition in advance of the razor blade, which comprises:

a. a soap cake;

b. a moisturizing element positioned adjacent to the upper surface of the soap cake;

c. a container means for holding said soap cake; and d. a means for securing the combination of soap cake and container means to said razor.

* * * * *